US005735483A

United States Patent [19]

Bierlein

[11] Patent Number: 5,735,483

[45] Date of Patent: Apr. 7, 1998

[54] CARDBOARD REEL CLIP HOLDER

[75] Inventor: Erick M. Bierlein, Cary, N.C.

[73] Assignee: Delaware Capital Formation, Inc., Wilmington, Del.

[21] Appl. No.: 671,174

[22] Filed: Jun. 27, 1996

[51] Int. Cl.[6] ..... B65H 75/14; B65H 75/18

[52] U.S. Cl. ..... 242/608.7; 242/610.1; 242/118.8; 242/118.61; 242/586

[58] Field of Search ..... 242/608.7, 610.1, 242/118.8, 532.5, 586.6, 118.61, 586

[56] References Cited

U.S. PATENT DOCUMENTS

| | | | |
|---|---|---|---|
| 1,118,689 | 11/1914 | Sharlow | 242/586.6 |
| 1,204,827 | 11/1916 | Schroeder | 242/586.6 |
| 2,799,458 | 7/1957 | Nye | 242/118.8 |
| 3,876,073 | 4/1975 | Herbetko | 242/118.8 |
| 3,958,775 | 5/1976 | Liga | 242/118.8 |

FOREIGN PATENT DOCUMENTS

| | | | |
|---|---|---|---|
| 629254 | 11/1927 | France | 242/610.1 |
| 3703018 | 8/1987 | Germany | 242/608.7 |
| 2165214 | 4/1986 | United Kingdom | 242/608.7 |

*Primary Examiner*—John Q. Nguyen
*Attorney, Agent, or Firm*—Banner & Witcoff, Ltd.

[57] ABSTRACT

A reel may be fabricated from three flat pieces of die-cut cardboard wherein the center or hub section is defined by laterally projecting tabs from a longitudinal strip. The tabs fit through pairs of slots defined in the side members of the reel. The entire construction may thus be fabricated from a flat stock material that is recyclable.

14 Claims, 3 Drawing Sheets

FIG. 4
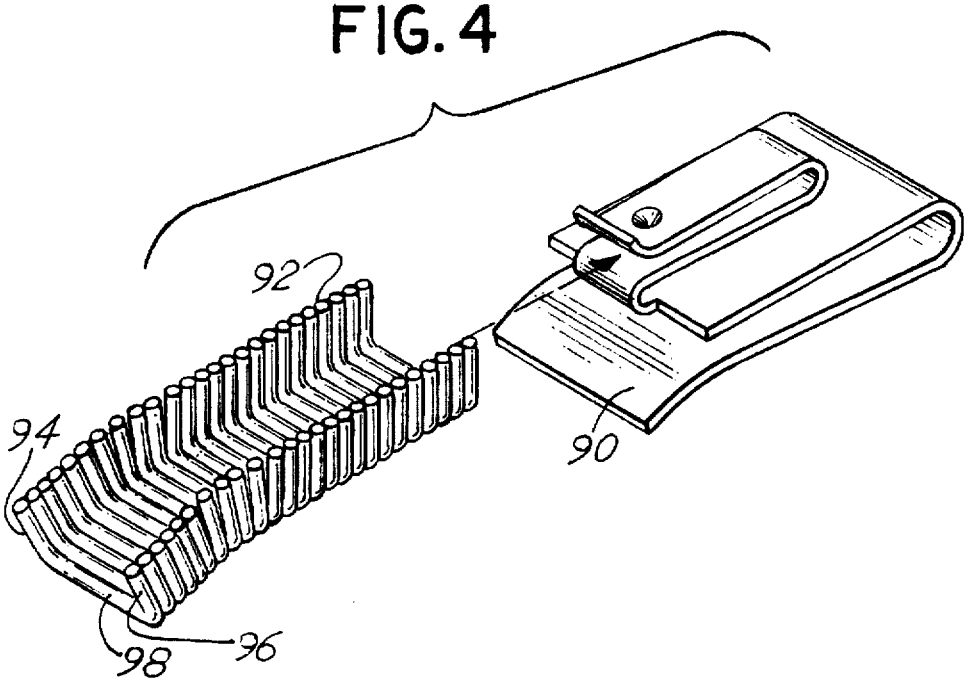
FIG 5
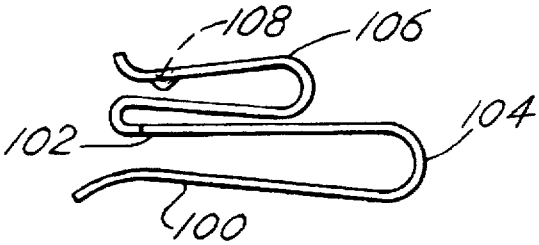
FIG. 7
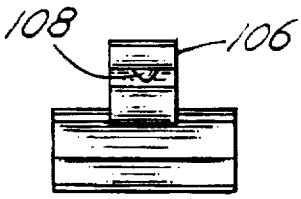
FIG. 6
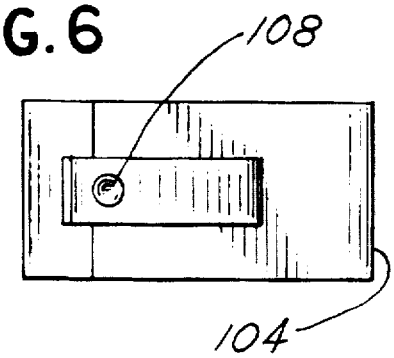
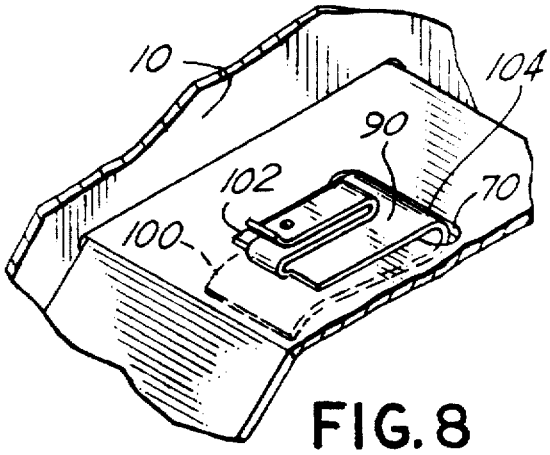
FIG. 8

CARDBOARD REEL CLIP HOLDER

BACKGROUND OF THE INVENTION

This invention relates to an improved reel that may be used for winding a length of flexible rope, cable, or any other item that is elongated and may be wound.

In order to effectively and efficiently transport lengths of flexible material, it is common practice to wind such materials on a reel. Reels are provided in many sizes, shapes, and configurations and are made from many various materials. Reels or spools, thus, may be utilized to store a material such as thread or a material such as heavy coaxial cable, steel cable and the like. Small plastic reels are typically utilized in the food and meat packaging industry to carry lengths of u-shaped metal clips that are aligned and taped together. The clips are typically wound on such reels for subsequent withdrawal for use in a packaging operation. U.S. Pat. No. 3,400,433 discloses a clip of the general type discussed. Such clips are u-shaped and aligned overlying each other and held in position by tape, for example, affixed to the outside crown surface of each clip. The clips are thus formed in strands.

Typically, molded plastic reels are utilized for the storage and transport of such strands of clips. The reels are molded and may or may not be reusable, depending upon sanitation requirements. The reels are somewhat bulky and are often difficult to recycle. Thus, there has developed a need to provide an improved reel, especially for use with lengths of joined clips.

SUMMARY OF THE INVENTION

Briefly, the present invention comprises a reel made from recyclable materials. The reel is comprised of three planer elements; namely, first and second side members and a hub section. The hub section is folded and includes tabs that engage and hold the planer side members to define the reel construction. The hub section, thus, includes a longitudinal strip defined by generally parallel, opposite sides. Projecting laterally from the strip, at various intervals on the opposite side, are locking tabs. The locking tabs are foldable and pass through slots in the first and second side members so as to provide a functional reel wherein the component parts are all made from a recyclable material such as cardboard or fiberboard. Further, with the construction of the invention, the reel may be transported to a remote site and assembled or disassembled, as the case may be. The reel may be easily recycled since it is made from cardboard material. The reel may be made in innumerable sizes inexpensively.

Thus, it is an object of the invention to provide an improved reel construction comprised of three separate elements, including a pair of side members and a central hub member that is folded and cooperates with the side members to define the reel construction.

A further object of the invention is to provide a reel construction that may be made from cardboard, fiberboard or similar material and which may be assembled easily in a minimum amount of time and at a site location.

Yet a further object of the invention is to provide an improved, low cost reel that may be utilized with numerous types of rope-like, cord-like, strands of clips and other materials that may be wound on a reel;

Yet another object of the invention is to provide a reel construction that is adapted to cooperate with fastener members or other items which may be wound on the reel.

These and other objects, advantages, and features of the invention will be set forth in the detailed description that follows:

BRIEF DESCRIPTION OF THE DRAWING

In the detailed description which follows, reference will be made to the drawing comprised of the following figures:

FIG. 4 is an isometric view of a clip or fastener, which is attached at the end of the rope or other item that is to be wound on the reel of the type shown in the prior FIGS. 1 through 3;

FIG. 5 is a side view of the clip of FIG. 4;

FIG. 6 is a plan view of the clip of FIG. 4;

FIG. 7 is an end view of the clip of FIG. 4;

FIG. 8 is an isometric view of the clip of FIG. 4 attached to the hub of a reel.

DESCRIPTION OF THE PREFERRED EMBODIMENT

Figure 1:
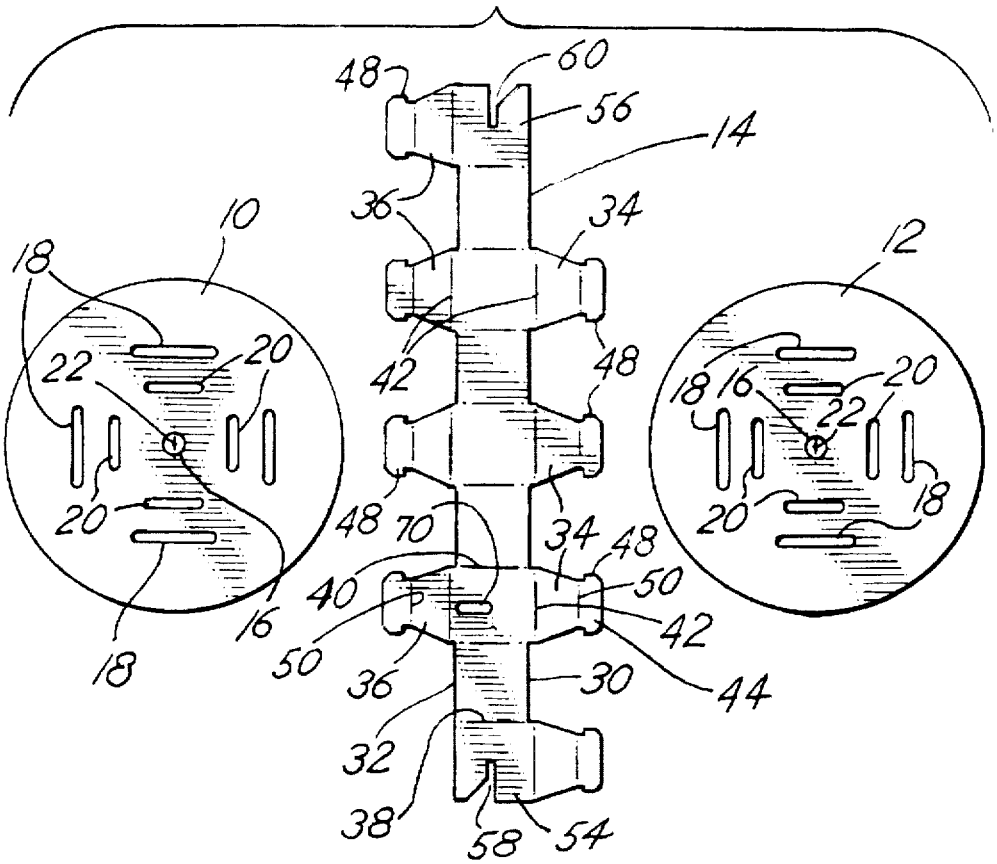
FIG. 1 is a plan view of the component parts of an embodiment of the invention prior to assembly thereof.

Referring especially to FIGS. 1 through 4, there is depicted the component parts of the reel of the invention in both assembled and disassembled condition, as well as in a partially assembled condition. The reel includes three component parts; namely, a first side member 10, a second side member 12 and a hub member 14. In the preferred embodiment, the side members 10 and 12 are circular and congruent, or in other words, equally sized and substantially identical. The component parts, or sides 10 and 12 and hub 14 are constructed out of a cardboard material, by way of example, or fiberboard or any similar material that may be easily recycled and that can be folded, and in particular, wherein the hub 14 may be folded. It is noted that the materials comprising the first and second side 10 and 12 may be different from the material that comprises the hub 14. That is, the first and second sides 10 and 12 may be a more inflexible or rigid material. In any event, the hub section 14 is necessarily a component part that can be folded along score lines as described.

Referring again to FIG. 1, the first and second sides 10, 12 include a center opening 16. Thus, the reel may be positioned on a rod or hub, for example, when material on the reel is being wound or unwound. Each side 10, 12, includes a series of pairs of slots, for example, slots 18 and 20. Each of the slots 18 and 20 have a particular configuration. First, slots 18 and 20 are each perpendicular to a radius from the center 22 of the first side member 10 or second side member 12. Second, the outer slot 18 is dimensionally greater in length than the length of the inner slot 20, in the preferred embodiment. Third, the slots 18 and 20 are radially spaced from one another so that, as will be apparent in the later description, an appropriate tab may be fitted through the slot 18, from the inside of the reel and then over the surface of the outside of the reel and then through the slot 20 to the inside of the reel.

The slots 18 and 20 are arranged in pairs about the center line axis 22. In the preferred embodiment, there are four pairs of slots 18 and 20 spaced circumferentially about the center 22 and spaced approximately 90° from one another. The outer slots 18 generally define the diameter formed by the hub 14, as will be described in greater detail below. The radial distance of each of these slots 18 about the center line axis 22 is substantially equal in order to provide for a circular hub. However, different configurations of the hub may be provided as may different configurations of the first and/or second side members 10 and 12. Additionally, differing numbers and shapes of slots 18 and 20 may be provided in the side members 10 and 12. Preferably, the slots 18 and 20 are provided in pairs. Most importantly, however, the slot 18 is necessary so that the tab end member, as described below, can be fitted therethrough and locked into position. Thus, it may be possible, in certain circumstances, to eliminate the slot 20 and to provide other means for retaining the hub member 14.

The hub member 14 is comprised of a longitudinal strip having a profile as shown, for example, in FIG. 1. The longitudinal strip, thus, includes first and second sides 30 and 32, which are generally parallel and spaced one from the other. The distance between the sides 30 and 32 defines the spacing between the side member 10 and 12 and also defines, therefore, the size of the hub defining the reel.

Integrally defined tabs 34 are positioned along one side of the hub member 14. Positioned on the opposite side of the hub member 14 are tab members 36. The tab member 34 and 36 are aligned, one with the other. The sides of the tab members 34 and 36 define a score line, such as score lines 38 and 40. The tabs 34, 36 in the embodiment shown, also define a score line, such as score line 42, along the line defined by the side 30. The width of the tab 34 along the score line 42 is substantially equal to or slightly less than the length of the slot 18. The tab 34, as all tabs in the embodiment shown, has a fustoconical shape and terminates with an end tab 44 that has lateral projections 46 and 48 at its opposite ends. Score line 50 is defined by the end tab 44. The projections 46 and 48 extend in opposite directions from one another by a distance that is slightly greater than the length of the slot 20, but less than the longitudinal slot 16. Thus, when the tab 44 is fitted through the slot 20, the projections 46 and 48 will effectively lock the tab 34 into position with he side member 10 or 12. Each of the tabs 34 and 36 are so constructed as described. The number of tabs on each side 30 and 32 is equal to the number of pairs of openings 18 and 20, found in the side members 10 and 12. The tabs 34 are spaced one from the other along side 30 as are the tabs 36, spaced on from the other, along the side 32. The sections of the hub 14 between the sets of tab 34, 36 define the hub.

The hub terminates with a projecting section or interlocking tab 54 at one end and section or interlocking tab 56 at its opposite end, with locking slots 58 and 60, respectively. Slots 58 and 60 are cut into the hub member 14 in a way that will permit the slot 58 to engage the slot 60 and, thereby, form the hub member 14 in the fashion depicted in FIG. 2. An optional passageway, or die-cut opening 70 may be formed in the hub member 14 for cooperation with a retaining clip. For example, a retaining clip 90 is shown in FIG. 5. This is described in greater detail below.

Figure 2:
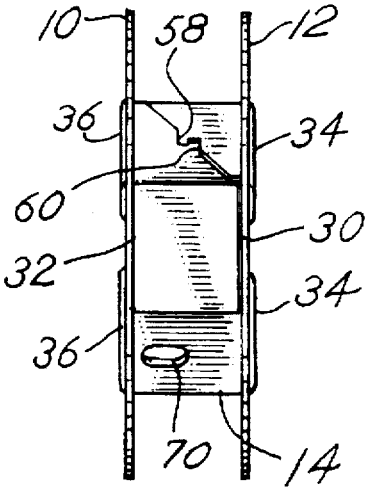
FIG. 2 is a plan view of the assembled components depicted in FIG. 1.
Figure 9:
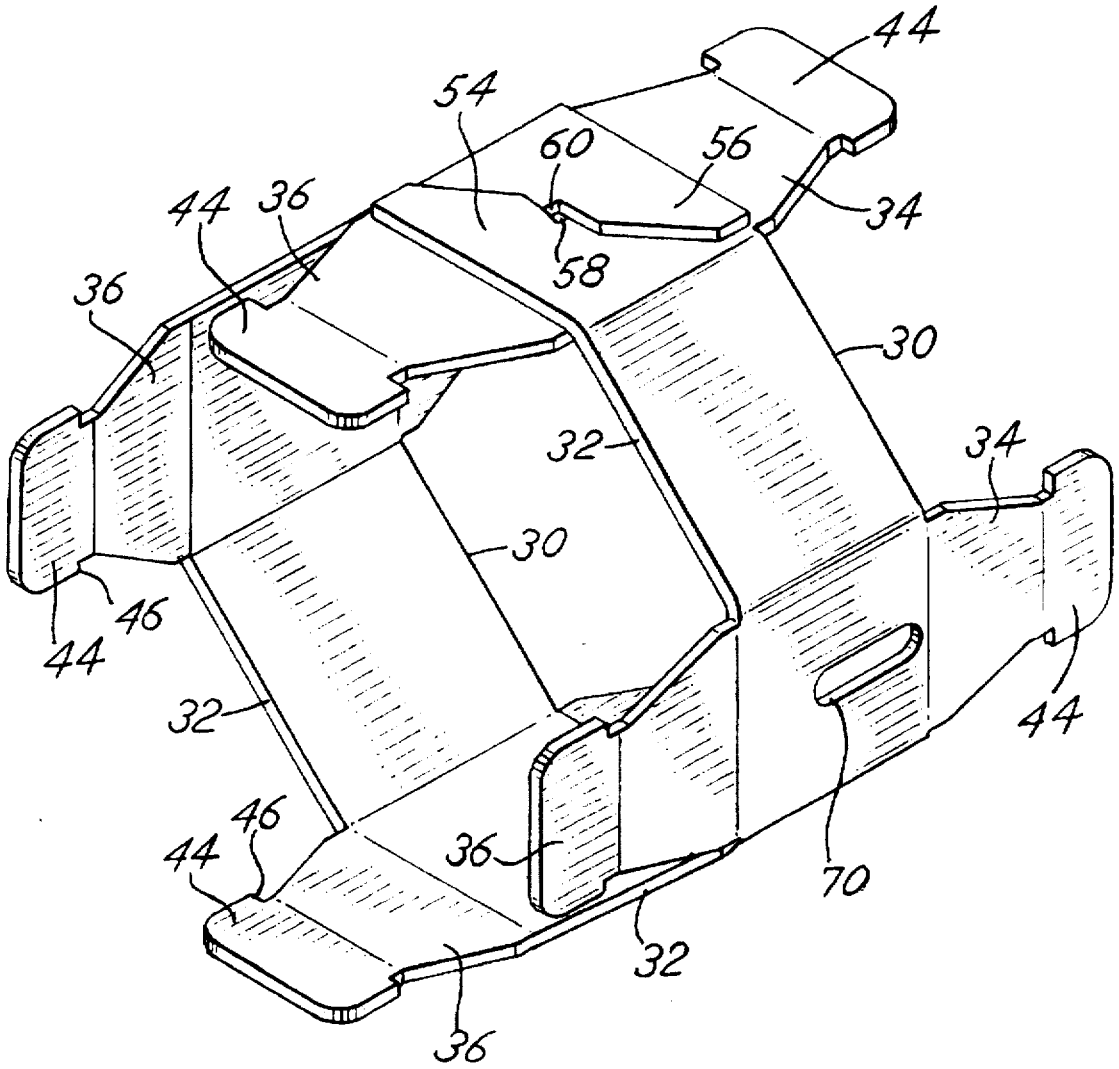
FIG. 9 is an enlarged isometric view of the hub of the reel folded and assembled so as to be in condition for receipt of the side members of the reel.

In any event, the hub member 14 is folded along the score lines 38 and 40 and formed into a generally multi-sided polygonal or a circular configuration, such as depicted in FIG. 4. Thereafter, the tabs 34 and 36, respectively, are fined through the slots 18 defined in the first and second side members 10 and 12, respectively. The tabs 34 and 36 are then folded along the appropriate score lines 42 and 50 so that the tabs 34 and 36 may be essentially locked or rigidly connected to the side members 10 and 12 by coaction or cooperation with the slots 18 and 20. FIG. 2 illustrates the assembled reel construction with FIG. 9 illustrating an interim step in the assembly; namely, the formation of the hub member 14 from flat stock.

Figure 3:
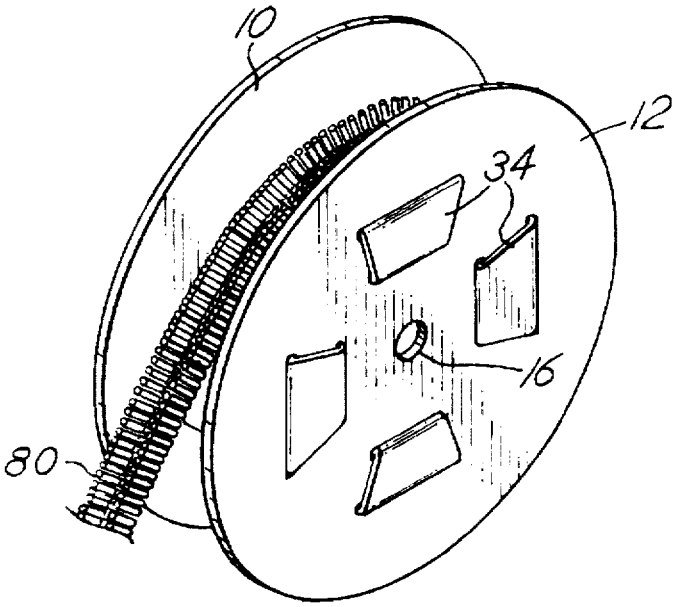
FIG. 3 is an isometric view of the assembly of the component parts in FIG. 1.

FIG. 3 illustrates the manner of the use of the reel. There a flexible strand of u-shaped metal clips retained together by means of a strip of adhesive material is shown as being wound on the hub member 14. The clips 80 are wound with their u-shaped legs projecting outwardly so that they can be easily wound around the hub 14.

Referring next to FIGS. 4 through 8, there are depicted a clip 90 that may coact or cooperate with the die-cut opening 70 in the hub member 14 to retain, for example, a strand of clips 92 on the hub 14. For example, the clips 92, which are generally u-shaped metal clips having outwardly extending legs 94 and 96, connected by a crown 98 wherein the crown 98 includes tape or some other means connecting the crowns, defines, in essence, a rope of clips 92. The retaining clip 90 is a u-shaped member having biased legs 100 and 102 connected by a crown 104. The clip 90, thus, is fabricated from a spring-type metal. A center strip or leg 106 of the clip 90 is bent or folded, as depicted in the Figures, so that it fits over and is juxtaposed with respect to the leg 102. A detent or tab 108 is defined in the leg 106. The crown 98 of one u-shaped metal fastener 92 is fitted to engage with the detent 108 by spring force associated with the leg 106. In this manner, the clips are initially held in place on the hub 14 and may be wound about that hub 14 with the crown 98 of the clips 92 opposed to the hub member 14.

Other types of retaining members are also possible. Additionally, it is not necessary to use a die-cut opening, such as the opening 70. Rather, a clip such as clip 90, may be attached to an end such as end section 54 or 56 of the hub, even though those end section 54 and 56 are joined together.

Various alternative constructions to that which described are possible. The number of tabs 34 and 36 may be varied. Thus, the invention is to be limited only by the following claims and their equivalents.

What is claimed is:

1. A reel for support of a rope of material wound on said reel, said reel being recyclable and comprised of an assembly of three flat planar recyclable members folded and assembled into a reel configuration, comprising in combination:

first and second side members, each member having an inside and an outside, said first and second side members having a center point, at least three substantially congruent, equally radially spaced pairs of slots, each of said pairs of slots characterized by an inner radial slot and an outer radial slot;

a hub section formed of a longitudinal strip with generally parallel, longitudinal side edges, said side edges having a length generally greater than the circumference of a hub for the assembled reel, and at least three pairs of tabs, each pair comprised of a first tab and a second tab, one of which extends laterally from one side edge and the other of which extends from the other side edge, said pairs of tabs spaced along the side edges so as to align with associated radial slots in the side members and being fitted therethrough from the inside of the side members over a portion of the outside and thence back to the inside to retain the hub section attached to the side sections and thereby form a reel; and said hub section further including opposite longitudinal ends, each end including an interlocking tab with a longitudinal slot in each interlocking tab, said slots of the interlocking tabs engaged to form one side of a multi-sided polygonal configuration.

2. The reel of claim 1 wherein the side members are circular.

3. The reel of claim 1 wherein the side members have a congruent profile.

4. The reel of claim 1 wherein the side members and hub member are of cardboard.

5. The reel of claim 1 wherein the side members are circular.

6. The reel of claim 1 wherein the side members include four pairs of equally radially spaced slots, each pair being circumferentially spaced 90°.

7. The reel of claim 1 wherein the side members have a congruent profile.

8. The reel of claim 1 wherein the hub strip includes a opening therethrough intermediate the opposite ends for coaction with an end of rope material.

9. The reel of claim 1 wherein the longitudinal side edges of the hub strip are spaced to define the size of the hub.

10. The reel of claim 1 wherein the reel further includes a rope retaining member engaged with the hub strip.

11. The reel of claim 10 wherein the retaining member comprises a retaining clip having first and second loops, the first loop for engaging the hub strip and the second loop for engaging the rope.

12. The reel of claim 1 wherein the side members and hub section are of cardboard.

13. The reel of claim 1 wherein the tabs include end sections which have greater dimension than the inner radial slot for locking each tab into an associated inner radial slot.

14. The reel of claim 1 wherein each outer radial slot has a greater length than each inner radial slot.

* * * * *